US006237844B1

(12) United States Patent
Purcell

(10) Patent No.: US 6,237,844 B1
(45) Date of Patent: May 29, 2001

(54) INSIDE BANGTAIL ENVELOPE

(75) Inventor: Douglas K. Purcell, Chicopee, MA (US)

(73) Assignee: Westvaco Corporation, Stamford, CT (US)

( * ) Notice: Subject to any disclaimer, the term of this patent is extended or adjusted under 35 U.S.C. 154(b) by 0 days.

(21) Appl. No.: 09/548,831

(22) Filed: Apr. 13, 2000

(51) Int. Cl.[7] ..... B65D 27/34

(52) U.S. Cl. ..... 229/313; 206/804; 229/70; 462/65

(58) Field of Search ..... 229/70, 313; 462/65; 206/804

(56) References Cited

U.S. PATENT DOCUMENTS

| | | | | |
|---|---|---|---|---|
| 121,860 | * | 12/1871 | Evans | 206/804 |
| 3,288,350 | | 11/1966 | Kushner | 229/70 |
| 3,356,285 | | 12/1967 | Greason | 229/70 |
| 3,374,940 | | 3/1968 | Allison | 229/70 |
| 3,406,894 | | 10/1968 | Settle | 229/70 |
| 3,460,743 | | 8/1969 | Burnett | 229/70 |
| 3,652,008 | * | 3/1972 | Grotefend | 229/313 |
| 4,470,511 | | 9/1984 | Meeker et al. | 206/610 |
| 4,607,749 | | 8/1986 | Jacob | 206/610 |
| 4,729,507 | * | 3/1988 | Kim | 229/313 |
| 5,967,403 | * | 10/1999 | Kranz | 229/70 |

* cited by examiner

*Primary Examiner*—Stephen P. Garbe

(57) ABSTRACT

The envelope of the present invention is prepared from a single blank of material to include a detachable inside bangtail flap, and a full access rear opening which exposes and automatically elevates the bangtail flap for easy removal when the envelope is opened.

2 Claims, 2 Drawing Sheets

INSIDE BANGTAIL ENVELOPE

BACKGROUND OF INVENTION

The present invention relates generally to an envelope structure which includes an inside, detachable bangtail flap. In particular, the present invention relates to an envelope structure which includes in combination, an inside bangtail flap, and a full access opening means located within the rear panel.

Full access opening means as employed in the present invention are known in the art. As used herein, the term full access opening means is intended to refer to any opening means that fully releases the top portion of an envelope panel to which the closure flap is adhered. In general, the panel in question is the rear panel since most envelopes have a closure flap attached to the front panel. Examples of such opening means are those that are disclosed in U.S. Pat. No. 4,607,749, entitled "Easy Open Envelope" and U.S. Pat. No. 4,470,511, entitled "Quick Opening Envelope". Likewise, envelopes which include bangtail flaps as contemplated by the present invention are known as shown for example in pending U.S. patent application Ser. No. 09/324,594, filed Jun. 3, 1999 and assigned to the present assignee herein. However, the present invention discloses for the first time the combination which includes a full access opening means and an inside bangtail flap in an envelope structure wherein when the envelope is opened, the bangtail flap is exposed and elevated from its location within the envelope for easy access.

SUMMARY OF INVENTION

The present invention is directed to a novel envelope construction which includes a full access opening feature and a detachable bangtail flap that is normally located interiorly of the envelope but which is fully exposed for easy access when the envelope is opened. The bangtail flap may comprise a coupon, return mailer or the like, or it may simply be used to provide advertising matter of interest to the recipient of the envelope. The envelope structure includes conventional features such as front panel, a closure flap foldably attached along one edge of the front panel and a rear panel foldably attached along the opposite edge of the front panel. In addition, as is conventional, side closure flaps may be foldably attached along the side edges of either the front or rear panel but they are generally attached to the front panel. However, in addition to the above, the envelope structure of the present invention also includes a full access rear opening and an inside bangtail flap detachably connected to the rear panel.

As referred to above, the extra flap is commonly referred to in the industry as a "bangtail" flap. The use of exterior bangtail flaps on envelopes is well known as shown, for example, in U.S. Pat. No. 3,356,285. It is also known, as shown for example in U.S. Pat. Nos. 3,288,350; 3,374,940; and 3,406,894, to provide extra flaps on various envelope panels which are folded inside an envelope structure for mailing. Likewise, it is also known to provide full access opening means for envelope structures which provide easy access to interior coupons, as shown in U.S. Pat. No. 3,460,743. However, the present invention is the first to combine an inside bangtail flap with a full access opening means wherein upon opening the envelope, the inside bangtail flap is automatically elevated for easy removal.

It is therefore an object of the present invention to provide an envelope of the type described which is user friendly with greater access to the contents than such envelopes in the past.

It is a further object of the present invention to provide an envelope where the envelope parts work together in a unique and novel fashion.

Other and more specific objects of the invention will become apparent from the following detailed description of the accompanying drawings which illustrate a preferred embodiment of the invention.

DETAILED DESCRIPTION

Figure 1:
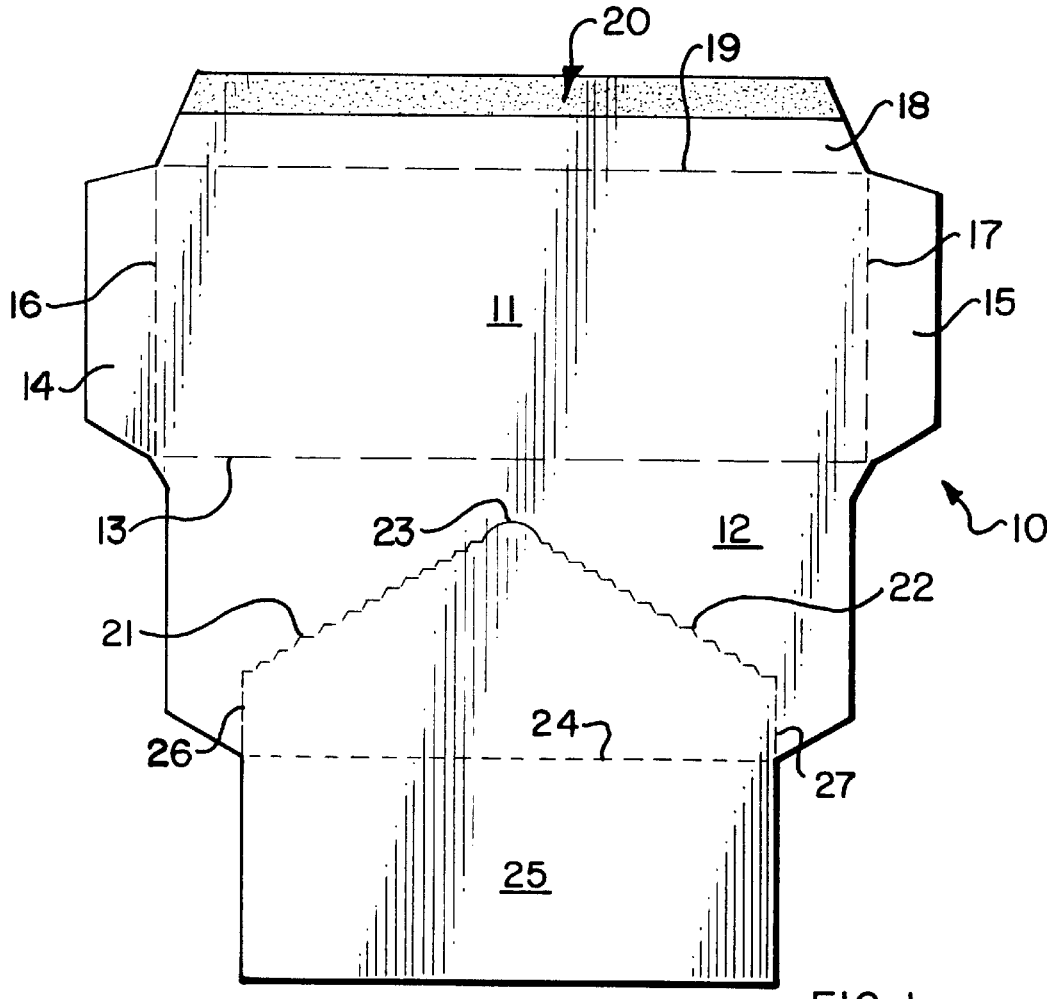
FIG. 1 is a plan view of a typical envelope blank structure suitable for forming the envelope structure of the present invention.

Referring to the drawings, there is shown in FIG. 1 a typical blank structure for forming the envelope of the present invention. Blank 10 includes a front panel 11 foldably attached to a rear panel 12 along a score line 13. The front panel also includes a pair of side closure flaps 14, 15 foldably attached to the side edges thereof along score lines 16, 17, although these flaps could just as readily be attached to the rear panel 12, and a top closure flap 18 foldably attached to the top edge of front panel 11 along score line 19. Top closure flap 18 also includes an adhesive strip 20 for closing the envelope.

Meanwhile, rear panel 12 also is provided with a full access opening means for easy opening of the envelope wherein upon opening the envelope, the top portion of rear panel 12 is separated from the bottom portion. As shown in the drawing, the preferred opening means is in the form of a pair of perforated lines 21, 22 formed with "hockey stick" style cut lines arranged generally in a V-shaped formation. It will be understood, however, that the opening means could just as readily be formed with a single line of perforations extending from one side of panel 12 to the other in such a manner that when opened, the top portion of panel 12 would be separated from the bottom portion. Nevertheless, as shown, the vertex of the V-shaped formation is defined by a generally semi-circular tab which can be grasped for opening the envelope by breaking the perforations. Rear panel 12 is further provided with an integral bangtail flap 25 foldably attached thereto along a perforated line 24.

Figure 2:
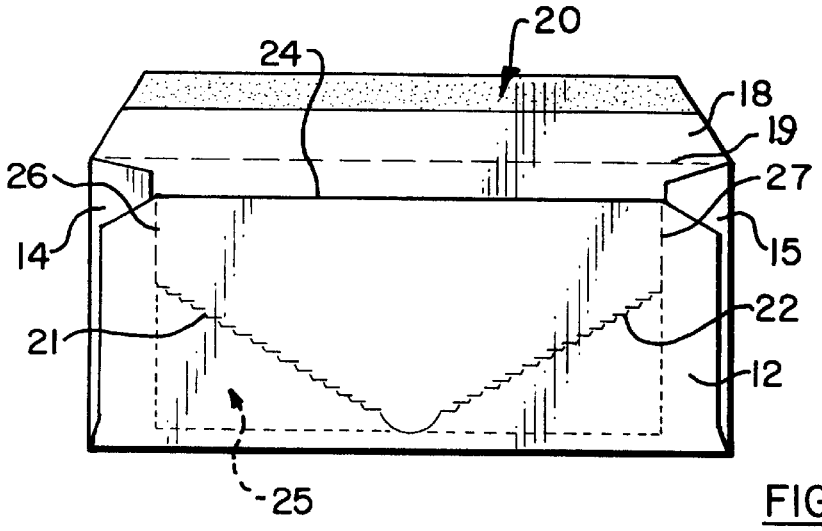
FIG. 2 is a plan view of the subject envelope from the rear with the closure flap in the open position.

FIG. 2 illustrates the envelope prepared from the blank of FIG. 1 in its formed but open condition. In this configuration, the side flaps 14, 15 are adhered to rear panel 12 and the bangtail flap 25 is folded inside the envelope body along scored/perforated line 24. The envelope blank structure is preferably pre-printed before forming so that the desired graphics whether they be for a coupon or other advertising matter are already applied to bangtail flap 25. Also note in FIG. 2 that the V-shaped perforated lines 21, 22 include severance lines 26, 27 which extend from the ends of the perforated lines 21, 22 to the top of rear panel 12 where they terminate at perforated score line 24. Severance lines 26, 27 are substantially collinear with the outer edges of the bangtail flap 25.

Figure 3:
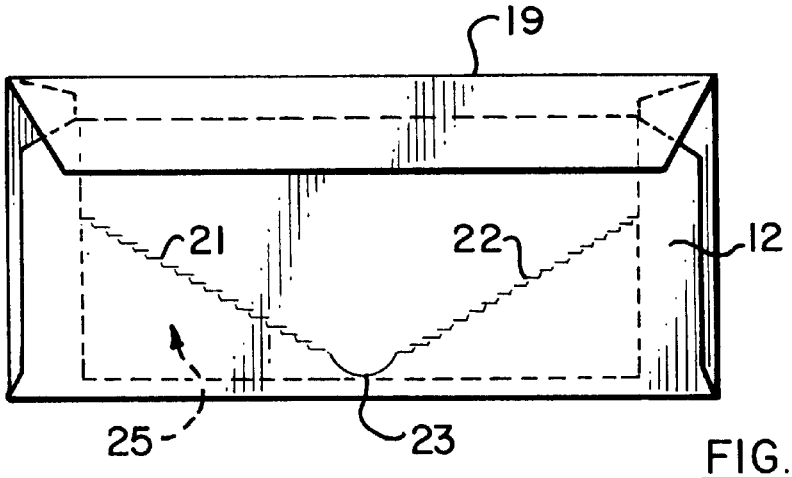
FIG. 3 is a plan view of the envelope of FIG. 2 in the closed position; and, FIG. 4 is a plan view of the envelope with the rear panel entirely separated along the perforations.

After the desired inserts are placed in the open envelope as shown in FIG. 2, the envelope is closed as shown in FIG. 3. At this point, the bangtail flap 25 is located inside the envelope where it is not immediately accessible, unlike the case with conventional bangtail flaps which are generally located on the outside of the envelope, particularly as disclosed in the aforementioned U.S. Pat. No. 3,356,285.

Figure 4:
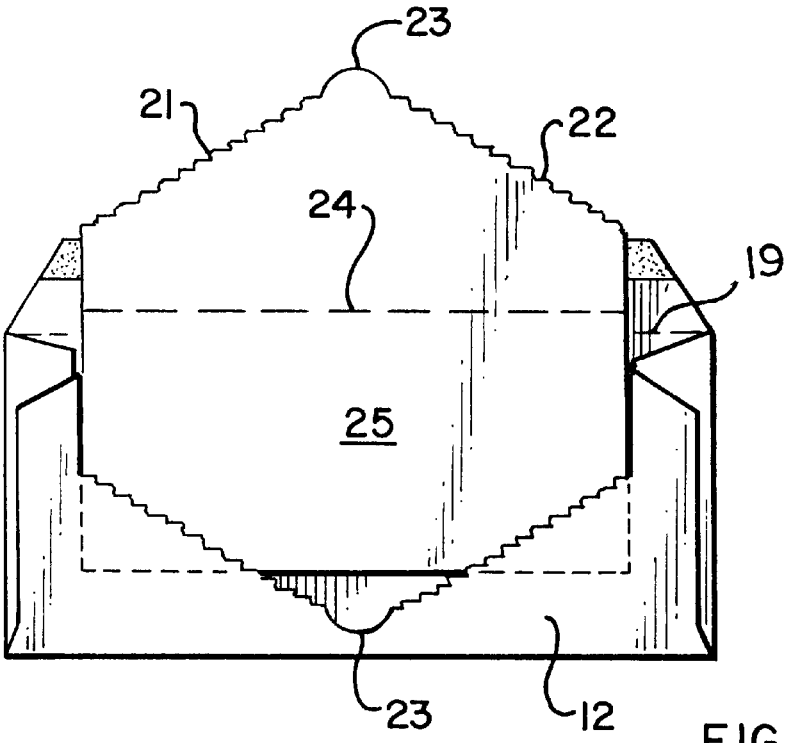

Upon receipt of the envelope, the recipient is directed to open the envelope to achieve access to the inside bangtail flap by lifting tab 23. As the recipient pulls the tab 23 away from the plane defined by the rear panel 12, and toward the top edge 19 of the envelope, the pulling force successively tears the rear panel 12 along the perforations 21, 22. As the last perforations 21, 22 are severed by the lifting force on tab 23, the severance lines 26, 27 are broken to allow the closure flap 18 to be folded upwardly. This action automatically elevates the bangtail flap 25 upwardly to a fully exposed position as shown in FIG. 4. At this point, the recipient can readily and easily grasp the bangtail flap 25, which may be a coupon, return mailer or the like, and separate it from the rear panel 12 along perforated line 24.

Accordingly, it may be seen that the present invention comprises in combination, a full access opening envelope with a detachable, inside bangtail flap wherein, upon opening the envelope, the bangtail flap is automatically elevated for easy access and removal. Thus, while the subject invention and its attendant advantages will be understood from the foregoing description of an exemplary embodiment, it will be apparent that various changes may be made in the form of the invention without departing from the spirit and scope of the invention as defined in the appended claims.

What is claimed is:

1. In combination, a full access opening envelope with an inside bangtail flap, said envelope comprising a body portion formed from a front panel and rear panel, side closure flaps foldably connected to the side edges of said front panel and adhered to said rear panel, and a top closure flap foldably connected to the top edge of said front panel for closing the envelope, the improvement wherein a bangtail flap is foldable connected along a perforated line to the top edge of said rear panel and tucked inside said envelope body portion, and a full access opening means is formed in said rear panel for separating the top portion of said rear panel from the bottom portion when the envelope is opened wherein the top portion of the rear panel is released from the envelope body portion and the bangtail flap foldably attached thereto is automatically elevated for easy access.

2. The envelope structure of claim 1 wherein the full access opening means comprises a pair of perforated lines formed by hockey stick style cut lines arranged generally in a V-formation in said rear panel, and a pair of severance lines are located one at each end of said V-formation which extend to the top of said rear panel and terminate at the perforation line connecting said rear panel and bangtail flap.

* * * * *